US008651843B2

(12) United States Patent
Schultz

(10) Patent No.: US 8,651,843 B2
(45) Date of Patent: Feb. 18, 2014

(54) HIGH EFFICIENCY FIXED DISPLACEMENT VANE PUMP

(75) Inventor: John C. Schultz, Saline, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 306 days.

(21) Appl. No.: 13/112,054

(22) Filed: May 20, 2011

(65) Prior Publication Data

US 2012/0034123 A1 Feb. 9, 2012

Related U.S. Application Data

(60) Provisional application No. 61/370,603, filed on Aug. 4, 2010.

(51) Int. Cl.
*F04C 2/00* (2006.01)
*F04C 15/00* (2006.01)
*F04C 27/00* (2006.01)

(52) U.S. Cl.
USPC ..... 418/110; 418/133; 418/257

(58) Field of Classification Search
USPC ..... 418/15, 82, 110, 257, 258, 259, 133
See application file for complete search history.

(56) References Cited

U.S. PATENT DOCUMENTS 2,255,783 A * 9/1941 Kendrick ..... 418/82
3,213,803 A * 10/1965 Meyer ..... 418/255
4,804,317 A * 2/1989 Smart et al. ..... 418/110
4,907,474 A * 3/1990 Bolger ..... 475/14
5,394,694 A * 3/1995 Doumov et al. ..... 60/363
5,916,054 A * 6/1999 Kobayashi ..... 475/220
7,798,299 B2 * 9/2010 Schultz ..... 192/3.27
2009/0241535 A1 * 10/2009 Schultz et al. ..... 60/486

FOREIGN PATENT DOCUMENTS

DE 19754285 A1 6/1999

OTHER PUBLICATIONS

Disclosed Anonymously, Vane Rings Used as Face Seals in Hydraulic Vane Pump, Research Disclosure Journal, ISSN 0374-4353, Nov. 2010, New York, NY.

* cited by examiner

*Primary Examiner* — Theresa Trieu

(57) ABSTRACT

A vane pump for an automatic transmission includes a housing which may be spaced from the axis of the transmission input shaft axis and driven by a chain or gear train driven by the torque converter hub or disposed on and about the axis of the transmission input shaft and driven at engine speed. The vane pump includes a pair of port plates which reside on the end faces of a pump body having a cylindrical chamber which receives an eccentrically disposed rotor that is coupled to a stub shaft. The rotor includes two halves that define a central chamber. The rotor also includes a plurality of radial slots which receive a like plurality of vanes. The outer ends of the vanes are in contact with the wall of the cylindrical chamber and the inner ends are in contact with a single vane ring received within the central chamber.

15 Claims, 4 Drawing Sheets

HIGH EFFICIENCY FIXED DISPLACEMENT VANE PUMP

CROSS-REFERENCE TO RELATED APPLICATIONS

This application claims priority to U.S. Provisional Application No. 61/370,603, filed on Aug. 4, 2010, which is hereby incorporated in its entirety herein by reference.

FIELD

The present disclosure relates to a hydraulic pump for an automatic transmission and more particularly to a high efficiency fixed displacement vane pump for an automatic transmission having a single vane ring and full vane rotor end faces.

BACKGROUND

The statements in this section merely provide background information related to the present disclosure and may or may not constitute prior art.

Hydraulic motor vehicle transmissions, that is, automatic transmissions for passenger cars and light duty trucks having a plurality of planetary gear assemblies controlled by clutches and brakes, generally include a dedicated hydraulic pump which provides pressurized transmission (hydraulic) fluid to control valves and actuators. These control valves and actuators engage the clutches and brakes and provide the various gear ratios or speeds.

Such dedicated pumps are generally fixed displacement pumps such as vane or gear pumps that are driven at engine speed from the hub of the torque converter or other startup device located between the engine and the transmission. Such pumps have many design goals. Since the pump is constantly driven at engine speed, it is desirable that it have high efficiency. Additionally, since the pump is most frequently mounted concentric to the engine axis, small size, particularly axial length, is desirable in order not to increase the length of the transmission. Such an on-axis engine driven pump must also be self-priming and must function reasonably well under cold start conditions when the transmission fluid has high viscosity because until hydraulic pressure is established, the transmission may be unable to shift into any gear.

SUMMARY

In one example of the principles of the present invention, a vane pump for an automatic transmission includes a housing which may be spaced from the axis of the transmission input shaft axis and driven by a chain or gear train driven by the torque converter hub or disposed on and about the axis of the transmission input shaft and driven at engine speed. The vane pump includes a pair of port plates which reside on the end faces of a pump body having a cylindrical chamber which receives an eccentrically disposed rotor that is coupled to a stub shaft. The rotor includes two halves that define a central chamber. The rotor also includes a plurality of radial slots which receive a like plurality of vanes. The outer ends of the vanes are in contact with the wall of the cylindrical chamber and the inner ends are in contact with a single vane ring received within the central chamber.

In one example of the present invention, the vane pump is suitable for use on both front wheel drive and rear wheel drive transmissions and drive trains.

In another example of the present invention, the vane pump is self-priming.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
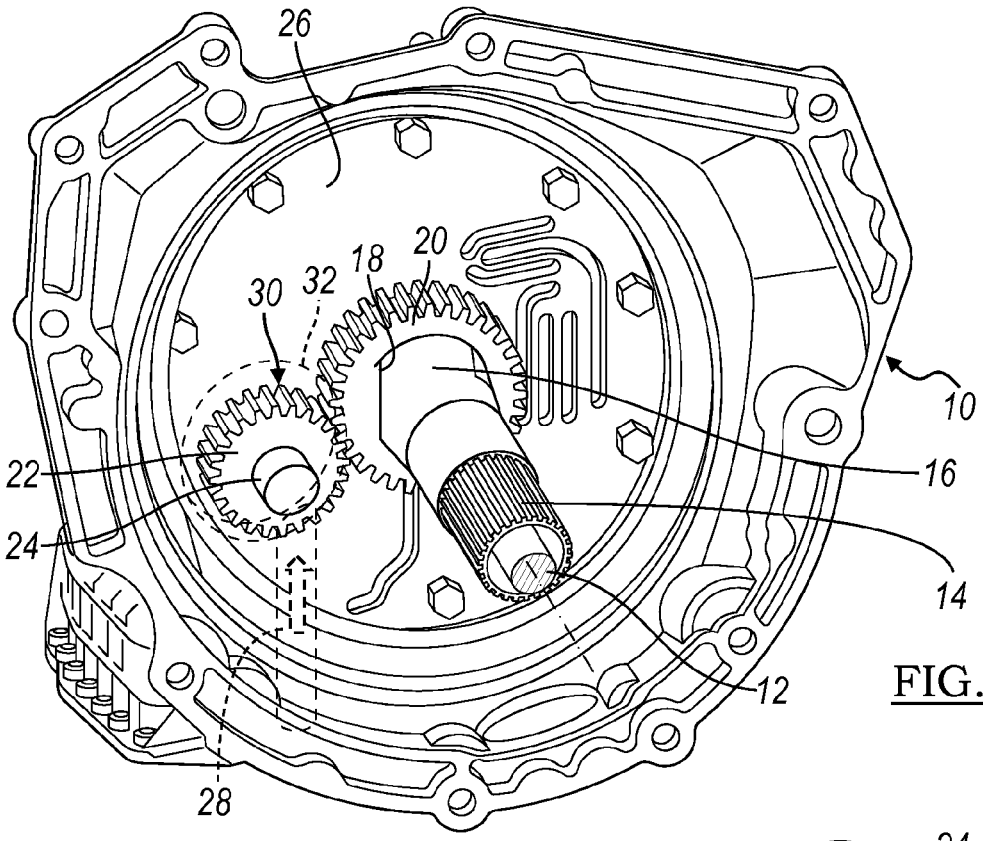
FIG. 1 is a front, perspective view of an exemplary automatic transmission housing incorporating an embodiment of a vane pump according to the principles of the present invention.

With reference to FIG. 1, a housing of a typical rear wheel drive (RWD) automatic transmission is illustrated and generally designated by the reference number 10. The transmission housing 10 is generally cast aluminum and includes openings, counterbores, flanges, shoulders and other features which receive, locate and support the various components of the automatic transmission. A drive or engine output shaft 12 is coupled to and drives a turbine of a torque converter (not illustrated). Disposed concentrically about the shaft 12 is a stationary quill or tube 14 that connects with the stator of the torque converter (not illustrated). Attached to the output or pump of the torque converter 16 by any suitable means such as, for example, complementary flats 18, interengaging splines, one or more drive pins or set screws, a friction fit or a combination of any of these elements is a first, drive gear 20. The first, drive gear 20 is in constant mesh with and drives a second, driven gear 22. The drive and driven gears 20 and 22 are may be any type of gear without departing from the scope of the present invention. The second, driven gear 22 is secured to and drives an input shaft 24 of a fixed displacement hydraulic pump 30. The hydraulic pump 30 is mounted in a support plate 26 which typically includes a fluid inlet or suction passageway 28 for the hydraulic pump 30. As illustrated in FIG. 1, a consequence of the rotational reversal (from clockwise to counter-clockwise) achieved by the gears 20 and 22 is that the suction passageway 28 is disposed more proximate the center of the transmission housing 10, improving porting and further enhancing the mounting flexibility of the hydraulic pump 30.

Figure 6:
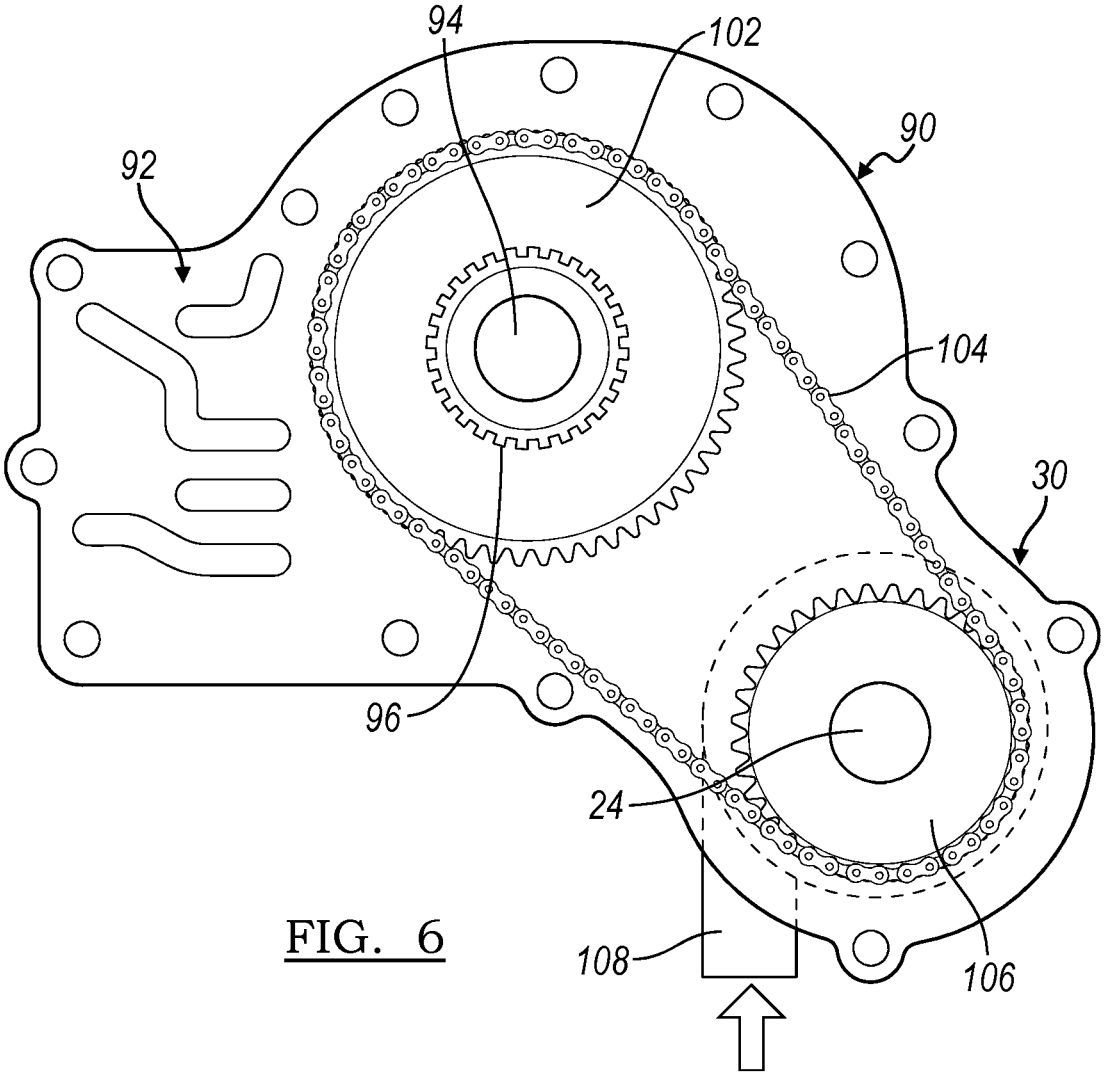
FIG. 6 is a front view of a pump body having a chain driven, off-axis, fixed displacement pump according to the principles of the present invention.

It should be appreciated that other parallel axis power transfer components such as a gear train or a pair of chain sprockets and a chain, such as illustrated in FIG. 6, may be utilized to drive the hydraulic pump 30, or the hydraulic pump 30 may be driven directly by the quill or drive tube 14. The latter arrangement necessitates significantly enlarging the diameter of the hydraulic pump 30, however, and this compromises certain improvements in efficiency. It should also be appreciated that whereas in a direct drive arrangement, the speed of the hydraulic pump 30 will and must always be the same as the speed of the engine and quill or drive tube 14, this drive arrangement readily facilitates a rotational speed difference between the speed of the drive tube 14 and the speed of the pump input shaft 24. For example, to improve slow speed operation and priming, the first, drive gear 20 may have a diameter larger than the diameter of the second, driven gear 22, thereby increasing the relative rotational speed of the hydraulic pump 30. As those familiar with gear and chain drive assemblies will readily understand, if it is desired that the hydraulic pump 30 rotate more slowly than the quill or drive tube 14, the larger and smaller diameter drive members need only be interchanged.

It should also be understood that the hydraulic pump 30 may be disposed proximate the quill or drive tube 14 at any convenient circumferential location. Finally, the hydraulic pump 30 may be driven directly or indirectly by a dedicated electric motor (not illustrated), an arrangement which provides exceptional mounting location freedom as well as the ability to provide pressurized fluid when the vehicle engine is not operating.

The hydraulic pump 30 may include its own, dedicated, generally cylindrical housing 32. The housing 32 is secured to or integrally formed with the transmission housing 10 or housed within the support plate 26 which is typically disposed at the front of the transmission housing 10.

Figure 2:
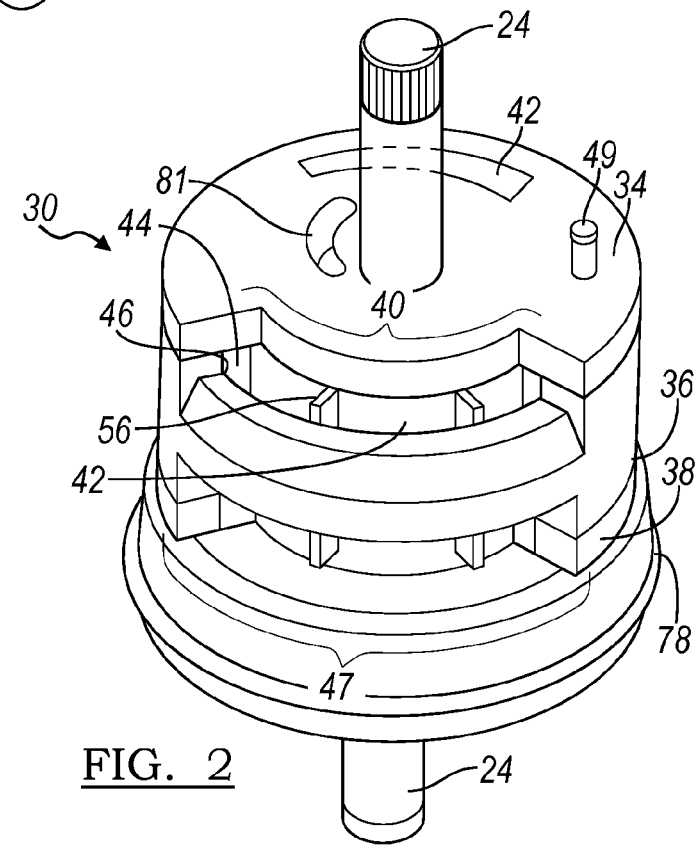
FIG. 2 is a perspective view of an embodiment of a vane pump according to the principles of the present invention.

Turning to FIG. 2, the hydraulic pump 30 includes a stack or sandwich of three major components received within the housing 32: a first circular port plate 34, a pump body 36, and a second circular port plate 38. The first port plate 34 defines a first circumferential inlet or suction port 40 and a first outlet or pressure port 42. The pump body 36 defines a cylindrical chamber 44 having a wall or inner surface 46. The second circular port plate 38 defines a second circumferential inlet or suction port 47 and a second outlet or pressure port 48 (best seen in FIG. 3). The three major components, the first circular port plate 34, the pump body 36 and the second circular port plate 38 are maintained in their proper relative rotational positions by one or more register pins or rods 49 that extend through at least portions of all three components.

Figure 3:
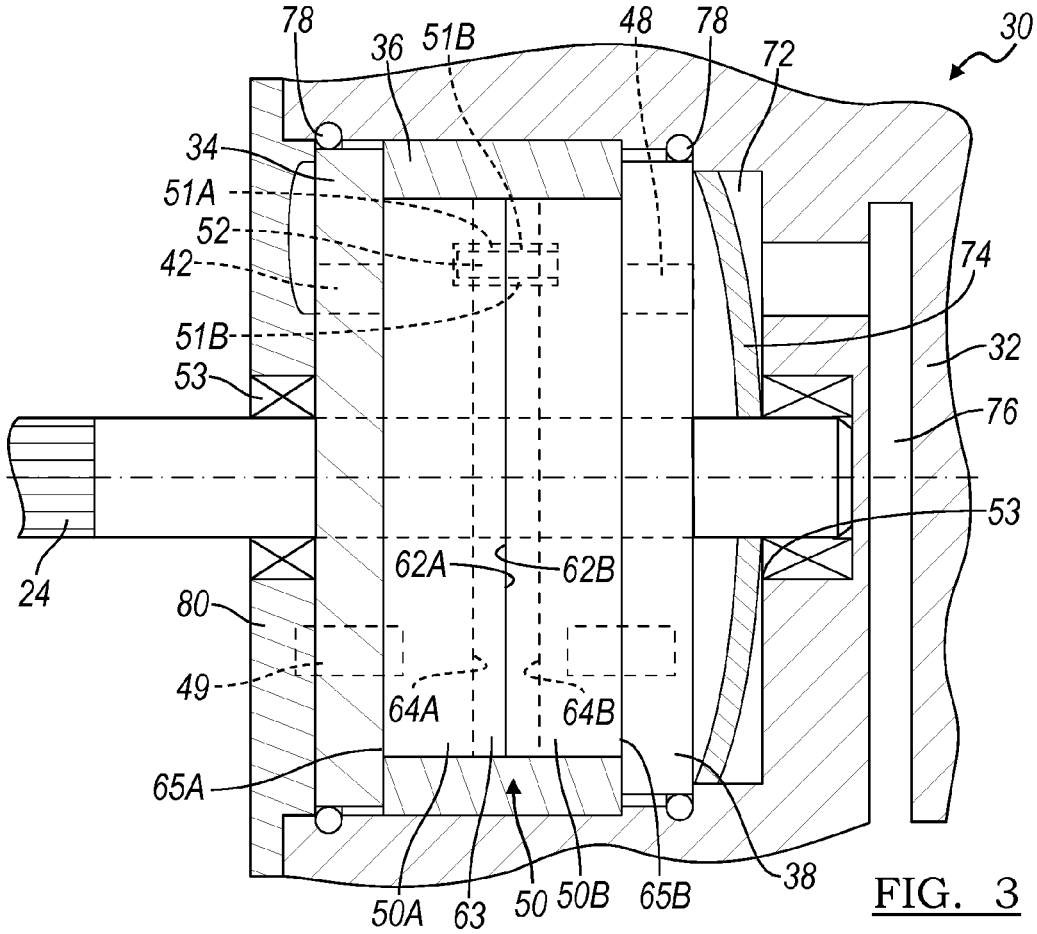
FIG. 3 is a side, elevational view in partial cross-section of an embodiment of a vane pump according to the principles of the present invention.
Figure 3A:
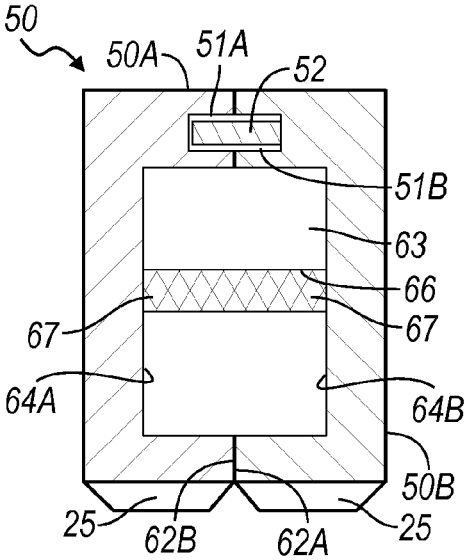
FIG. 3A is a partial side cross-sectional view of an embodiment of a vane rotor used in the vane pump according to the principles of the present invention.
Figure 3B:
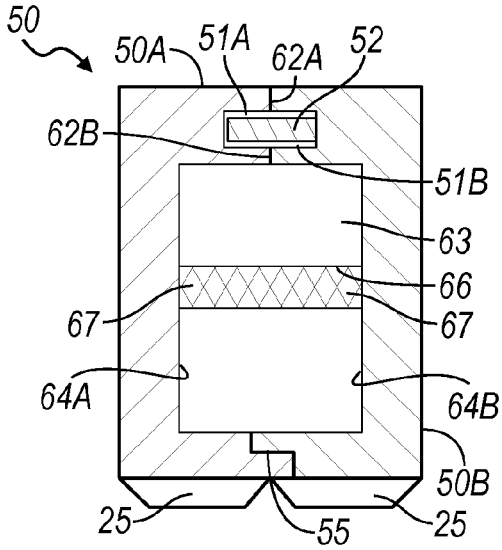
FIG. 3B is a partial side cross-sectional view of another embodiment of a vane rotor used in the vane pump according to the principles of the present invention.

Turning to FIGS. 3 and 3A, and with continued reference to FIG. 2, disposed eccentrically, i.e., offset from the axis of the cylindrical chamber 44, is a pump or vane rotor 50. The vane rotor 50 is divided into two separate halves 50A and 50B. The rotor halves 50A and 50B are substantially identical, however, rotor half 50A includes an alignment hole 51A and rotor half 50B includes an alignment pin or dowel 52 disposed in a like alignment hole 51B. It should be appreciated that which rotor half 50A and 50B includes which of the alignment hole 51 and alignment pin 52 may vary without departing from the scope of the present invention. The pin 52 is press fit into the holes 51A and 51B to hold the two rotor halves 50A and 50B together to prevent internal pump leakage, thereby improving volumetric efficiency of the pump 30. The In addition, the number of alignment holes and matching pins may vary without departing from the scope of the present invention. The alignment pin 52 mates with the alignment hole 51 in order to radially and rotationally align the rotor halves 50A and 50B with one another. The rotor halves 50A and 50B are driven by connecting with the shaft 24 via splines 25, flats, or any other suitable method. Therefore, the vane rotor 50 is coupled to, is driven by and rotates with the shaft 24. In turn, the shaft 24 may be supported on a pair of bushings 53 or anti-friction bearings such as ball bearing assemblies. In an alternate embodiment, shown in FIG. 3B, the alignment holes 51A and 51B and alignment pin 52 may be replaced with, or supplemented by, a press fit hub 55 that further reduces fluid leakage between the rotor halves 50A and 50B.

With reference to FIGS. 3, 3A, 4 and 5, the rotor 50 includes a plurality of radial slots or channels 54 which receive a like plurality of blades or vanes 56. The radial slots 54 and the corresponding vanes 56 extend through both rotor halves 50A and 50B. Preferably, the rotor 50 includes nine of the slots or channels 54 and a like number of vanes 56 although this number can be adjusted up or down depending upon the size (diameter) of the rotor 50 and other design constraints and operating parameters. For reasons of pumping efficiency, it is desirable that the thickness of the vanes 56 be as thin as possible. Good results have been achieved with vanes on the order of 1.25 millimeters and thinner. It should be appreciated, however, that as the overall size (diameter) of the pump 30 increases to accommodate, for example, a torque converter hub or large shaft, the thickness of the vanes 56 will typically increase above the thickness just recited. Thin vanes 56 not only increase the volume of fluid pumped per revolution of the vane rotor 50 relative to a pump having thicker vanes but also reduce the energy required to radially translate the vanes 56 relative to vanes having greater mass.

The eccentric disposition of the vane rotor 50 within the pumping chamber 44 creates a curved or crescent shaped pumping chamber 60 which is the active portion of the cylindrical chamber 44. The curved or crescent shaped pumping chamber 60 has a vanishing radial distance or dimension where the vane rotor 50 is most proximate but clears the wall or inner surface 46 of the cylindrical chamber 44 and a maximum radial distance or dimension which is nominally equal to the difference between the diameter of the cylindrical chamber 44 and the diameter of the vane rotor 50. Proximate each end of the curved or crescent shaped pumping chamber 60 are the fluid ports. Assuming the rotation of the rotor 50 is clockwise as viewed in FIG. 4, the ports 40 and 47 proximate the increasing portion of the curved region 60 are inlet, suction or supply ports and the ports 42 and 48 proximate the decreasing portion of the pumping chamber 60 in the first circular port plate 34 and the second circular port plate 38, respectively, are outlet, pressure or supply ports. It will be appreciated that the ports 42 and 48 may define multiple openings and, alternatively, that they may be disposed in the wall or inner surface 46 of the cylindrical chamber 44.

Figure 4:
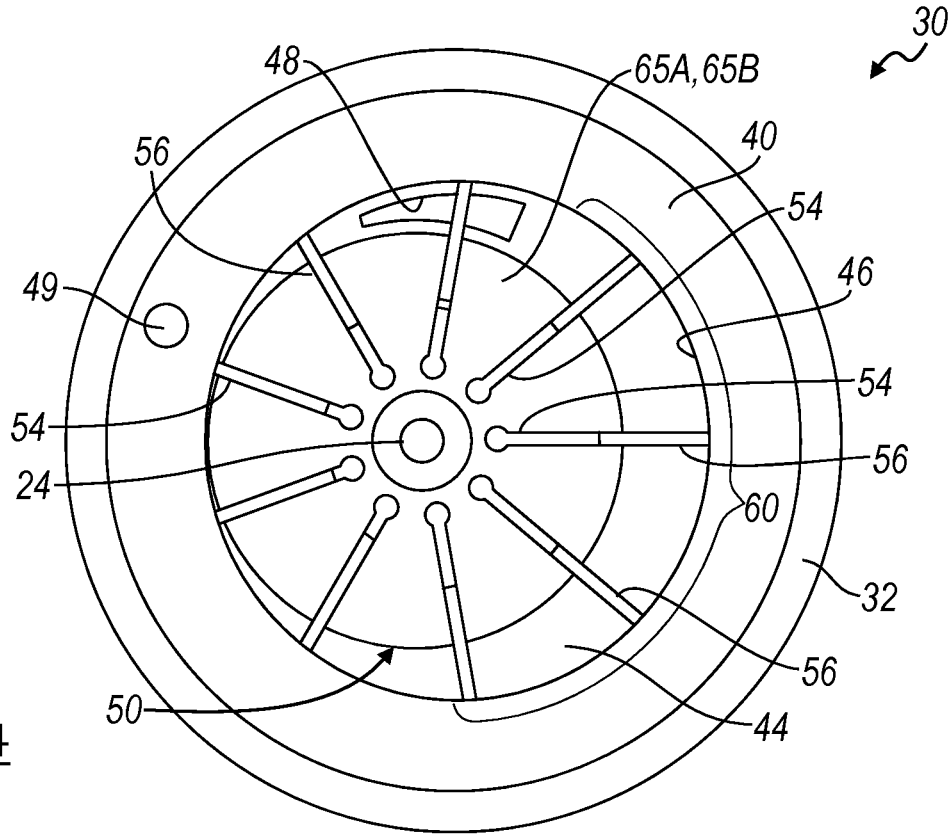
FIG. 4 is an end view of an embodiment of a vane pump according to the principles of the present invention with a port plate removed.

Each rotor half 50A and 50B includes an inner end that includes a shoulder or axially projecting lip 62A and 62B, respectively, that defines a shallow, circular, re-entrant portion or recess 64A and 64B, respectively. The alignment holes 51A and 51B are located in the lip 62A and 62B, respectively. The rotor halves 50A and 50B are mated such that the lips 62A and 62B contact and cooperate to define a central chamber 63 located within the vane rotor 50. Accordingly, as best seen in FIG. 4, each rotor half 50A and 50B includes a full, flat rotor face or outer end surface 65A and 65B, respectively, which is substantially planar and smooth. Enclosing the vane ring 66 between the two rotor halves 50A and 50B enables the full. rotor faces 65A and 65B on both ends of the rotor 50 to sealingly contact the port plates 34 and 38, respectively, thereby improving volumetric efficiency via less internal pump leakage. In addition, the full rotor faces 65A and 65B enables pressurization under the vanes 56 to reduce leakage across the tips of the vanes 56, as will be described in greater detail below.

The axial length of the vane rotor 50 between the faces of the shoulders or lips 62A, 62B is preferably equal to the width (or axial dimension) of the vanes 56 (and just slightly less than the thickness of the pump annulus or body 36) and the axial distance between the circular, re-entrant portions or recesses 64A, 64B is significantly less. Received within central chamber 63 of the vane rotor 50 is a vane ring or annulus 66. The vane ring 66 floats or is freely disposed within the central chamber 63. The outside diameter of the vane ring 66, which is preferably circular, plus the radial length of two of the vanes 56 total very slightly less than the diameter of the cylindrical chamber 44. Thus, the vanes 56 are constrained both at their inner edges or ends by the vane ring 66 and at their outer edges or ends by the wall or inner surface 46 of the cylindrical chamber 44. Preferably, the vane ring 66 has ends 67, best seen in FIG. 3B, that are sealed against or have minimal clearance with the surfaces 64A and 64B in order to prevent leakage across the vane ring 66.

The vane ring 66 greatly improves cold performance of the fixed displacement pump 30 by self priming the vanes 56 at cold temperatures as low as approximately negative 40 degrees Celsius by holding the vanes 56 close to the wall or inner surface 46 of the cylindrical chamber 44. Moreover, this feature greatly improves self-priming and cold start performance as the constrained vanes 56 again provide a close fit of approximately 0.1 to 0.2 mm clearance or any dimension that just allows the rotor 50 to rotate freely relative to the wall or inner surface 46 at low rotational speeds when centrifugal force is minimal and when the high viscosity of the fluid inhibits outward radial translation of the vanes 56.

Returning to FIG. 3, the housing 32 which receives the first circular port plate 34, the pump annulus or body 36 and the second circular port plate 38 includes a recessed region 72 which receives a wave washer or Belleville spring 74 which applies a compressive force or preload to these three components of the sandwich or stack, improves the fluid seal therebetween and thus further improves the efficiency of the pump 30 particularly at low, initial, or start-up speeds and pressures. The full rotor face 65B provides a greater surface area of contact with the second port plate 38, thereby reducing the wear between the rotor 50 and the second port plate 38 due to the compressive force of the spring 74. The recessed region 72 collects, is filled with and communicates with a fluid outlet passageway 76.

Axial pressure compensation further reduces leakage in the pump 30 and further improves its efficiency. The outside (rear) surface of the second port plate 38 is exposed to the pressure of the pumped fluid and is therefore biased toward the pump annulus or body 36, in proportion to the pump output pressure, thereby further improving the seal between the three components of the sandwich. A plurality of O-ring seals 78 disposed between various elements of the pump 30 and the housing 32 also further reduce fluid leakage and improve efficiency. An end plate 80 which supports the bushing or bearing 53 and which may include suitable openings for threaded fasteners (not illustrated) seals and closes off the open end of the housing 32.

Figure 5:
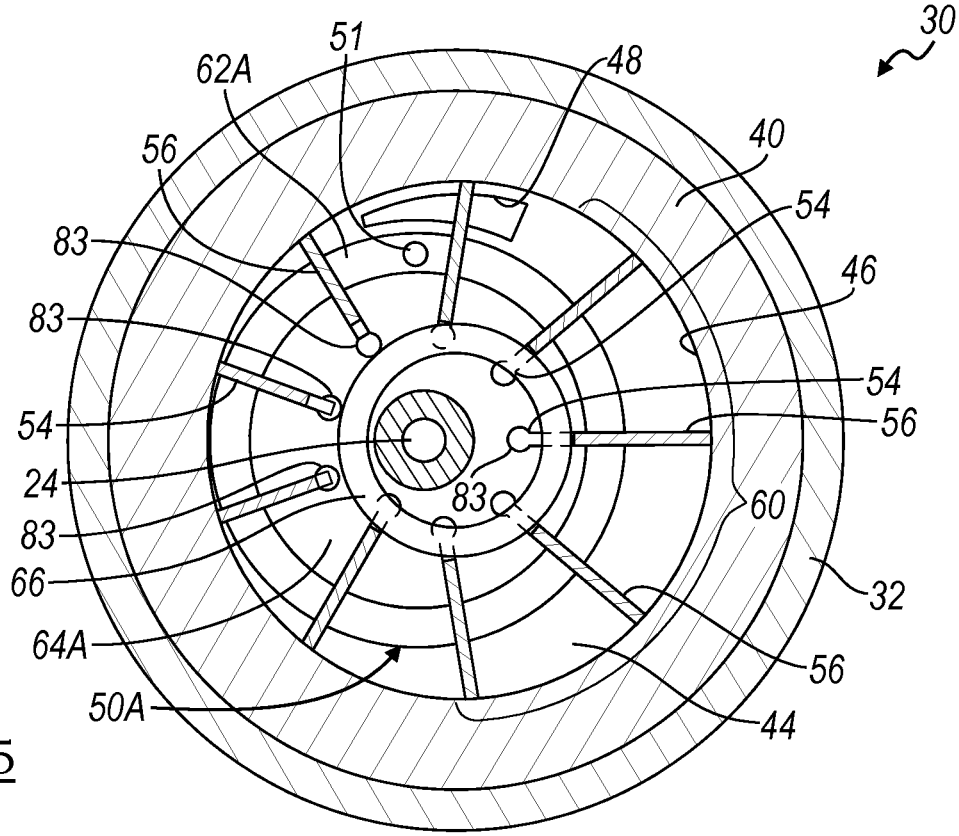
FIG. 5 is an end view in partial cross-section of a portion of an embodiment of a vane pump according to the principles of the present invention.

Returning to FIG. 2 and with continued reference to FIG. 3, the first port plate 34 may include a window 81 that extends through the port plate 34. The window 81 is disposed above the vane slots 54 that are preferably counter-clockwise to the output port 42. A window (not shown) may likewise be included in the second port plate 38 aligned with the window 81. As seen in FIG. 5, vane slot ends 83 of the vane slots 54 that are disposed counter-clockwise of the port 48 are exposed outboard of the vane ring 66. Therefore, as the axial pressure of the fluid in the recessed region 72 increases, the pressurized hydraulic fluid communicates through the windows 81 and enter the vane slot ends 83, thereby allowing under vane pressurization. Under vane pressurization urges the vanes 56 against the inner wall 46 so that less fluid flows around the vane tips against the direction of rotation of the vane rotor 50 and vanes 56.

Referring now to FIG. 6, an alternate drive arrangement, typically for a front wheel drive (FWD) transmission, having a chain drive assembly is illustrated. In FIG. 6, the hydraulic pump 30 of the present invention is disposed in a prismatic housing 90 which may be disposed at any convenient location within the transmission housing 10, e.g., within the sump or at a level above the sump. The prismatic housing 90 typically includes hydraulic control valve passageways 92 as well as other passageways and receives a drive shaft 94 or other drive member such as a torque converter hub (not illustrated). Secured to the drive shaft 94 through any conventional means such as tangs, splines or flats 96 is a chain drive sprocket 102. The chain drive sprocket 102 engages and drives a chain 104 which, in turn engages and drives a driven chain sprocket 106. The driven chain sprocket 106 is secured by suitable means to the drive shaft 24 of the hydraulic pump 30 of the present invention. A fluid inlet passageway 108 communicates between a sump (not illustrated) and the inlet ports 40 and 48 (illustrated in FIG. 2). It will be appreciated that this chain driven, off-axis arrangement again permits relative speed adjustment between the drive shaft 94 and the pump input shaft 24 by adjusting the relative diameters of the drive sprocket 102 and the driven sprocket 106.

The construction and configuration of the hydraulic pump 30 provides high pumping efficiency. Such efficiency is the result of several aspects of the pump 30 of the present invention. First of all, in its preferred configuration and disposition, it is mounted off-axis in a transmission. In this way, the shaft 24 which drives the vane rotor 50 may be small, on the order of nine to twelve millimeters, rather than disposed on the much larger torque converter hub, sometimes as large as fifty millimeters which can significantly increase the diameter of the pump 30. The overall smaller pump diameter and component size of an off-axis pump reduces rotational and sliding friction, reduces rotating internal leakage and permits tighter tolerances, all factors which improve operating efficiency. In addition, an off-axis design facilitates other drive arrangements such as by a dedicated electric motor which has the additional capability of driving the pump when the engine is not running in, for example, engine start-stop (ESS) applications.

Furthermore, an off-axis design and the necessary accompanying drive arrangement such as sprockets and a chain or gears or a gear train allow a rotational speed increase or decrease relative to the rotational speed of the engine. This is useful because the typical limiting (minimum) pump flow occurs at low r.p.m., such as engine idle speed, and it may be desirable to increase this speed such that pump flow is greater at low engine speeds.

The inclusion of the single vane ring 66 within the rotor halves 50A and 50B renders the pump of the present invention self-priming. Maintaining close tolerances reduces internal pump leakage along rotor faces and adjacent to all surfaces and edges of the vanes which improves volumetric efficiency. Thus, the pump 30 may be disposed above a sump and its fluid level, or at any desired off-axis location, either within the sump, below or above the nominal fluid level or at another location above or remote from the sump. This location/mounting flexibility facilitates use of a pump according to the present invention in both front wheel drive (FWD) and rear wheel drive (RWD) transmissions and drive trains.

An additional aspect of the reduced size, tight tolerances and the resultant self-priming ability is that the pump 30 provides good cold start flow and pressure due to the positively controlled radial movement of the vanes 56. Moreover, these benefits are achieved by the pump configuration of the present invention utilizing conventional transmission fluid.

The description of the invention is merely exemplary in nature and variations that do not depart from the gist of the invention are intended to be within the scope of the invention. Such variations are not to be regarded as a departure from the spirit and scope of the invention.

The following is claimed:

1. A device for pumping a fluid, the device comprising:

a body concentric with a first axis, the body defining a pump chamber having a first open end and an inlet that receives the fluid;

a first plate sealingly connected to the body disposed over the first open end, the first plate having an outlet that communicates with the pump chamber;

a rotor rotatably supported about a second axis within the pump chamber, wherein the second axis is offset from and parallel to the first axis, the rotor having a first open ended cylindrical portion in contact with a second open ended cylindrical portion to define a central chamber, and wherein the rotor includes a plurality of radially and axially extending slots disposed through the first cylindrical portion and the second cylindrical portion;

a plurality of vanes radially slidably disposed within the plurality of slots, the plurality of vanes each having an inner end and an outer end; and a ring disposed freely within the central chamber radially inward of the plurality of vanes, wherein the ring is configured to limit the radial inward movement of the plurality of vanes, and whereby the fluid is pumped from the inlet of the body to the outlet of the first plate as the rotor rotates causing the outer ends of a subset of the plurality of vanes to contact the body and the inner ends of the subset of the plurality of vanes to contact the ring.

2. The device of claim 1 wherein the first cylindrical portion includes an outer end surface that is flat and planar and contacts an inner surface of the first plate.

3. The device of claim 1 wherein the pump chamber includes a second open end and the device further comprises a second plate sealingly connected to the body disposed over the second open end, the second plate having an outlet that communicates with the pump chamber.

4. The device of claim 3 wherein the second cylindrical portion includes an outer end surface that is flat and planar and contacts an inner surface of the second plate.

5. The device of claim 1 wherein the plurality of vane slots extend radially inwardly from outer surfaces of the first and second portions and terminate in slot ends, and wherein the first plate includes a window disposed overtop the slot ends of a second subset of the plurality of vanes that are radially outward of the ring as the rotor rotates, wherein the window communicates fluid from the outlet to the slot ends of the second subset of the plurality of vanes to urge the vanes located within the subset of the plurality of vanes radially outward.

6. The device of claim 1 wherein the first cylindrical portion includes an inner end having an axially extending circumferential lip that defines the open end of the first cylindrical portion and the second portion includes an inner end having an axially extending circumferential lip that defines the open end of the second cylindrical portion, and wherein the circumferential lips of the first cylindrical portion and the second cylindrical portion are in contact to define the central chamber within and between the first and second cylindrical portions of the rotor.

7. The device of claim 1 wherein the first cylindrical portion includes a first feature and the second cylindrical portion includes a second feature, wherein the first and second features interact to radially and axially align the first and second cylindrical portions relative to one another.

8. The device of claim 7 wherein the first and second features are mated axially extending surfaces.

9. The device of claim 7 wherein the one of the first and second features is a pin and the other of the first and second features is a hole, wherein the pin is press fitted within the hole.

10. The device of claim 1 wherein the rotor is cylindrical and the first portion and second portion form cylindrical halves of the rotor.

11. The device of claim 1 wherein the plurality of vane slots are spaced equidistant around the circumference of the rotor and have centerlines that intersect with the second axis.

12. A pump assembly comprising:

a drive shaft;

a first gear connected to the drive shaft;

a second gear intermeshed with the first gear;

a pump input shaft connected to the second gear; and a pump comprising:

a body concentric with a first axis, the body defining a pump chamber having a first open end and an inlet that receives the fluid;

a first plate sealingly connected to the body disposed over the first open end, the first plate having an outlet that communicates with the pump chamber;

a rotor rotatably supported about a second axis within the pump chamber and connected to the pump input shaft, wherein the second axis is offset from and parallel to the first axis, the rotor having a first open ended cylindrical portion in contact with a second open ended cylindrical portion to define a central chamber, and wherein the rotor includes a plurality of radially and axially extending slots disposed through the first cylindrical portion and the second cylindrical portion;

a plurality of vanes radially slidably disposed within the plurality of slots, the plurality of vanes each having an inner end and an outer end; and a ring disposed around the pump input shaft within the central chamber radially inward of the plurality of vanes, wherein the ring is configured to limit the radial inward movement of the plurality of vanes, and wherein the drive shaft drives the first gear, the first gear drives the second gear, and the second gear drives the pump input shaft to drive the rotor.

13. The pump assembly of claim 12 further comprising a housing, wherein the first and second gear are located on a first side of the housing and the pump is located on an opposite second side of the housing, and wherein the pump input shaft extends through the housing.

14. A pump assembly comprising:

a drive shaft;

a first sprocket connected to the drive shaft;

a second sprocket;

a chain connected to the first sprocket and the second sprocket a pump input shaft connected to the second sprocket; and a pump comprising:

a body concentric with a first axis, the body defining a pump chamber having a first open end and an inlet that receives the fluid;

a first plate sealingly connected to the body disposed over the first open end, the first plate having an outlet that communicates with the pump chamber;

a rotor rotatably supported about a second axis within the pump chamber and connected to the pump input shaft, wherein the second axis is offset from and parallel to the first axis, the rotor having a first open ended cylindrical portion in contact with a second open ended cylindrical portion to define a central chamber, wherein the rotor includes a plurality of radially and axially extending slots disposed through the first cylindrical portion and the second cylindrical portion and wherein the first cylindrical portion includes a first feature and the second cylindrical portion includes a second feature that interact to radially and axially align the first and second cylindrical portions relative to one another;

a plurality of vanes radially slidably disposed within the plurality of slots, the plurality of vanes each having an inner end and an outer end; and a ring disposed within the central chamber radially inward of the plurality of vanes, wherein the ring is configured to limit the radial inward movement of the plurality of vanes, and wherein the drive shaft drives the first sprocket, the first sprocket drives the second sprocket via the chain, and the second sprocket drives the pump input shaft to drive the rotor.

15. The pump assembly of claim 14 further comprising a prismatic housing, wherein the first and second sprocket are located on a first side of the prismatic housing and the pump is located on an opposite second side of the prismatic housing, and wherein the pump input shaft extends through the prismatic housing.

* * * * *